US011165177B2

(12) United States Patent
Kawashima et al.

(10) Patent No.: US 11,165,177 B2
(45) Date of Patent: Nov. 2, 2021

(54) BOARD CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Naomichi Kawashima, Mie (JP); Hirokazu Komori, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 83 days.

(21) Appl. No.: 16/608,807

(22) PCT Filed: Apr. 9, 2018

(86) PCT No.: PCT/JP2018/014837
§ 371 (c)(1),
(2) Date: Oct. 25, 2019

(87) PCT Pub. No.: WO2018/198732
PCT Pub. Date: Nov. 1, 2018

(65) Prior Publication Data

US 2021/0104830 A1 Apr. 8, 2021

(30) Foreign Application Priority Data

Apr. 28, 2017 (JP) ..... JP2017-089471

(51) Int. Cl.
*H01R 12/57* (2011.01)
*H01R 12/70* (2011.01)
(Continued)

(52) U.S. Cl.
CPC ..... *H01R 12/7023* (2013.01); *H01R 12/57* (2013.01); *H01R 12/707* (2013.01);
(Continued)

(58) Field of Classification Search
CPC .... H01R 12/716; H01R 12/707; H01R 12/75; H01R 13/113; H01R 13/627; H01R 13/631; H01R 13/665; H01R 39/08; H01R 39/64
See application file for complete search history.

(56) References Cited

U.S. PATENT DOCUMENTS 4,629,266 A * 12/1986 Viselli ..... H01R 12/716 439/81
4,688,875 A * 8/1987 O'Connor ..... H01R 13/33 439/554
(Continued)

FOREIGN PATENT DOCUMENTS

JP 11-67374 3/1999
JP 11-111407 4/1999
(Continued)

OTHER PUBLICATIONS

International Search Report dated May 15, 2018.

*Primary Examiner* — Truc T Nguyen
(74) *Attorney, Agent, or Firm* — Gerald E. Hespos; Michael J. Porco; Matthew T. Hespos

(57) ABSTRACT

A board connector (A) has a housing (10) placed on a circuit board (P). The board connector (A) includes a terminal holding portion (11) and a receptacle (13) extending forward from an outer peripheral edge of the terminal holding portion (11). Terminal fittings (25, 26) are mounted while penetrating through the terminal holding portion (11) and are connectable to the circuit board (P) while being placed on the circuit board (P) behind the terminal holding portion (11). Locks (19) are formed on the housing (10) and restrict a forward tiling displacement of the housing (10) by being locked to the circuit board (P).

7 Claims, 10 Drawing Sheets

(51) Int. Cl.
*H01R 12/72* (2011.01)
*H01R 13/405* (2006.01)

(52) U.S. Cl.
CPC ..... *H01R 12/721* (2013.01); *H01R 12/724* (2013.01); *H01R 13/405* (2013.01)

(56) References Cited

U.S. PATENT DOCUMENTS 5,147,220 A * 9/1992 Lybrand ..... H01R 13/658 439/567
5,346,404 A * 9/1994 Shimada ..... H01R 43/205 439/108
5,354,207 A * 10/1994 Chikano ..... H01R 12/727 439/79
6,053,767 A * 4/2000 Copper ..... H01R 12/7029 439/567
6,081,998 A 7/2000 Terauchi et al.
6,095,826 A * 8/2000 Potters ..... H01R 12/724 439/79
6,123,564 A * 9/2000 Belmore, III ..... H01R 13/518 324/538
6,644,995 B1 * 11/2003 Jones ..... H01R 13/4362 439/260
7,223,128 B1 * 5/2007 Bogese ..... H01R 24/64 439/676
7,445,503 B1 * 11/2008 Zhang ..... H01R 13/41 439/607.01
2001/0049213 A1 * 12/2001 Potters ..... H01R 12/727 439/80
2003/0096517 A1 * 5/2003 Ho ..... H01R 12/7029 439/79
2007/0099515 A1 * 5/2007 Wang ..... H01R 12/725 439/660
2010/0176896 A1 * 7/2010 Payne ..... H01P 5/085 333/33
2010/0297888 A1 * 11/2010 Lim ..... H01R 12/707 439/660
2011/0097946 A1 * 4/2011 Chen ..... H01R 13/41 439/708
2012/0021641 A1 * 1/2012 Briant ..... H01R 12/707 439/571
2013/0095686 A1 4/2013 Aihara
2015/0372424 A1 * 12/2015 Little ..... H01R 13/642 439/217
2016/0126677 A1 * 5/2016 Yu ..... H01R 13/6474 439/607.23
2018/0309243 A1 * 10/2018 Kurosawa ..... H01R 12/716

FOREIGN PATENT DOCUMENTS

JP 2009-295549 12/2009
JP 2012-059501 3/2012

* cited by examiner

BOARD CONNECTOR

BACKGROUND

Field of the Invention

The invention relates to a board connector.

Related Art

Japanese Unexamined Patent Publication No. 2012-59501 discloses a board connector to be mounted on the upper surface of a circuit board. The board connector includes a housing made of synthetic resin. The housing includes a terminal holding portion and a rectangular tubular receptacle extending forward from the outer peripheral edge of the terminal holding portion. Terminal fittings penetrate through the terminal holding portion so that tip parts of the terminal fittings are accommodated in the receptacle, and rear end parts thereof are exposed behind the terminal holding portion. The board connector is mounted on the circuit board by first placing the housing at a predetermined position on the circuit board. The board connector and the circuit board then are passed through a reflow furnace and solder on the circuit board is melted under a high-temperature environment so that the terminal fittings are fixed to the circuit board.

If a board connector of this type is changed in specifications to be waterproof, a mating connector is formed with a tubular fitting for protecting a sealing ring and this tubular fitting portion is fit to the outer periphery of the receptacle. To avoid the interference of the tubular fitting externally fit to the receptacle with the circuit board, the receptacle needs to project outward of the circuit board in a plan view. Thus, when the board connector is placed on the circuit board, the board connector may tilt forward and detach from the circuit board.

The invention was completed on the basis of the above situation and aims to provide a board connector placeable on a circuit board.

SUMMARY

The invention is directed to a board connector with a housing placed on a circuit board. The housing including a terminal holding portion and a receptacle extending forward from an outer peripheral edge of the terminal holding portion. A terminal fitting penetrates through the terminal holding portion and is connectable to the circuit board while being placed on the circuit board behind the terminal holding portion. A locking portion is formed on the housing and is locked to the circuit board to restrict a forward tiling displacement of the housing by being locked to the circuit board. Thus, the board connector can be placed stably on the circuit board.

The terminal fitting may include a board connecting portion that can be placed on the circuit board and fixed to the circuit board by soldering, and the locking portion is disposed substantially at the same position as the board connecting portion in a front-rear direction. When the housing is tilted forward and displaced, a front edge of the circuit board serves as a fulcrum of a forward tiling displacement. Since the locking portion is disposed substantially at the same position as the board connecting portion of the terminal fitting in the front-rear direction, a vertical displacement amount of the board connecting portion is suppressed to be equal to or less than the amount of rattling between the locking portion and the circuit board even if vertical rattling occurs between the locking portion and the circuit board. In this way, the terminal fitting can be reliably connected to the circuit board.

The locking portion may be disposed on a rear part of the housing. When the housing is tilted forward and displaced, the front edge of the circuit board serves as a fulcrum of a forward tiling displacement. Since the locking portion is disposed on the rear end part of the housing, a vertical displacement amount of the housing is suppressed to be equal to or less than the amount of rattling between the locking portion and the circuit board even if vertical rattling occurs between the locking portion and the circuit board. In this way, the terminal fitting can be connected reliably to the circuit board.

A side wall may extend rearward from a side edge part of the terminal holding portion. Additionally, a fixing bracket that is fixable to the circuit board by soldering may be mounted on the side wall. The locking portion is disposed behind the fixing bracket. When the housing is tilted forward and displaced, the front edge of the circuit board serves as a fulcrum of a forward tiling displacement. Since the locking portion is disposed behind the fixing bracket, a vertical displacement amount of the fixing bracket is suppressed to be equal to or less than the amount of rattling between the locking portion and the circuit board even if vertical rattling occurs between the locking portion and the circuit board. In this way, the fixing bracket can be soldered reliably to the circuit board.

A side wall may extend rearward from a side edge part of the terminal holding portion. The side wall may be formed with a leg connected via a resilient supporting portion, and the locking portion is formed on a lower end part of the leg. Dimensional errors of the circuit board and the housing can be absorbed by resilient deformation of the resilient supporting portion.

Left and right side walls may extend rearward from side edge parts of the terminal holding portion and may be disposed to sandwich the terminal fitting, and fixing brackets may be mounted on the side walls. The fixing brackets may be fixable to the circuit board by soldering. Additionally, the locking portions may be continuous with the side walls. According to this configuration, the side walls have a function of supporting the fixing brackets, a function of protecting the terminal fitting from both left and right sides and a function of supporting the locking portions. Thus, the shape of the housing can be simplified.

DETAILED DESCRIPTION

Figure 1:
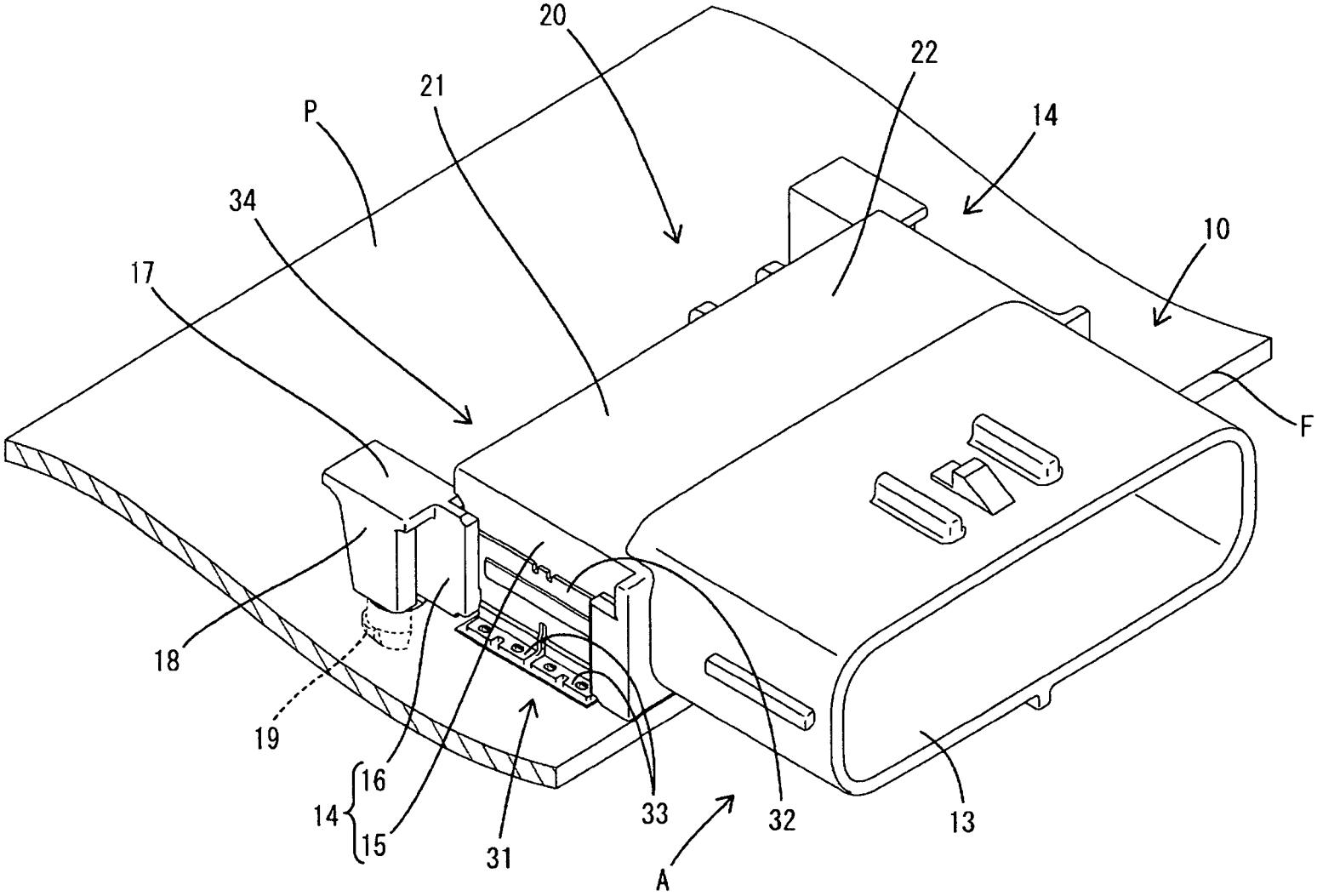
FIG. 1 is a perspective view in a state where a board connector of an embodiment is mounted on a circuit board.
Figure 2:
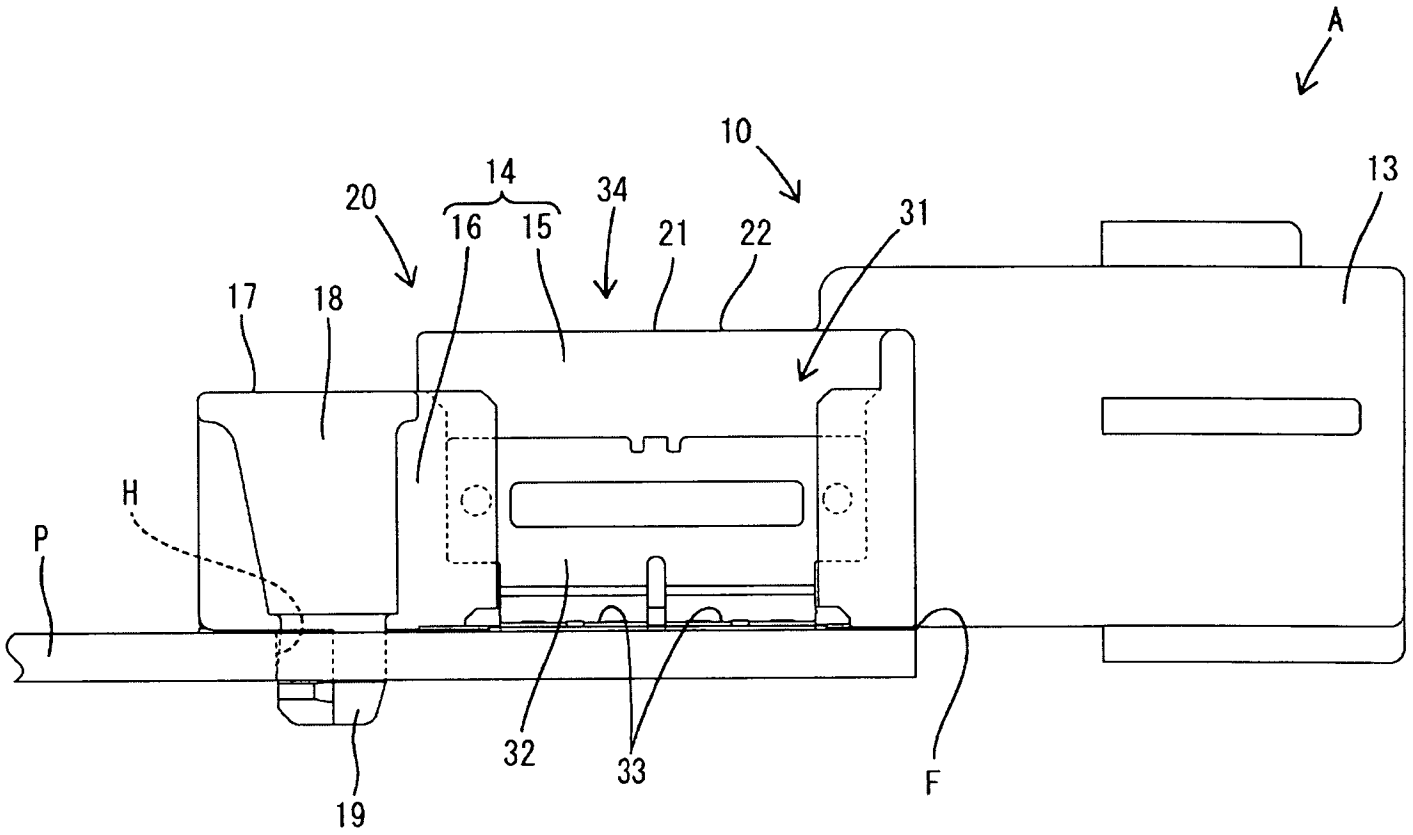
FIG. 2 is a side view in the state where the board connector is mounted on the circuit board.
Figure 3:
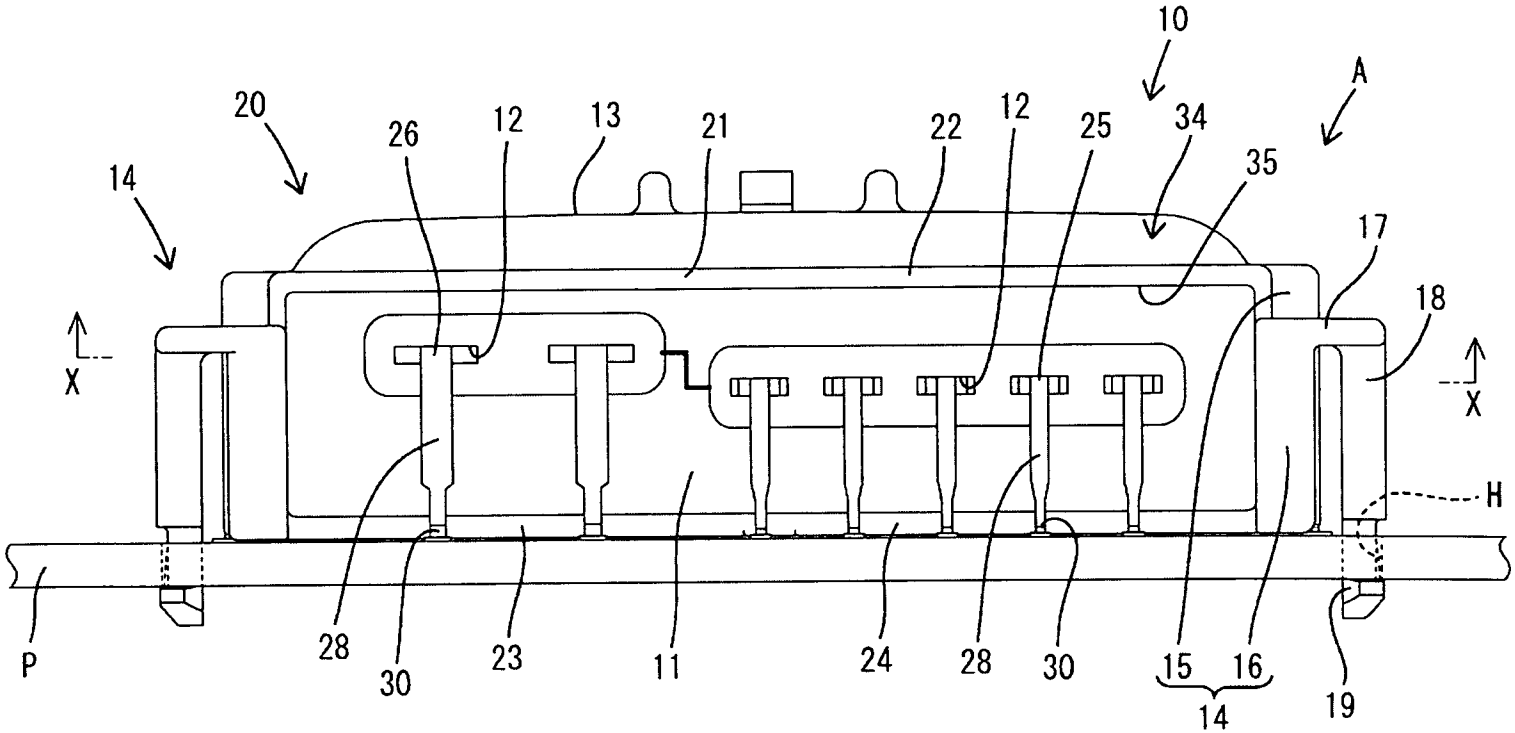
FIG. 3 is a back view in the state where the board connector is mounted on the circuit board.
Figure 4:
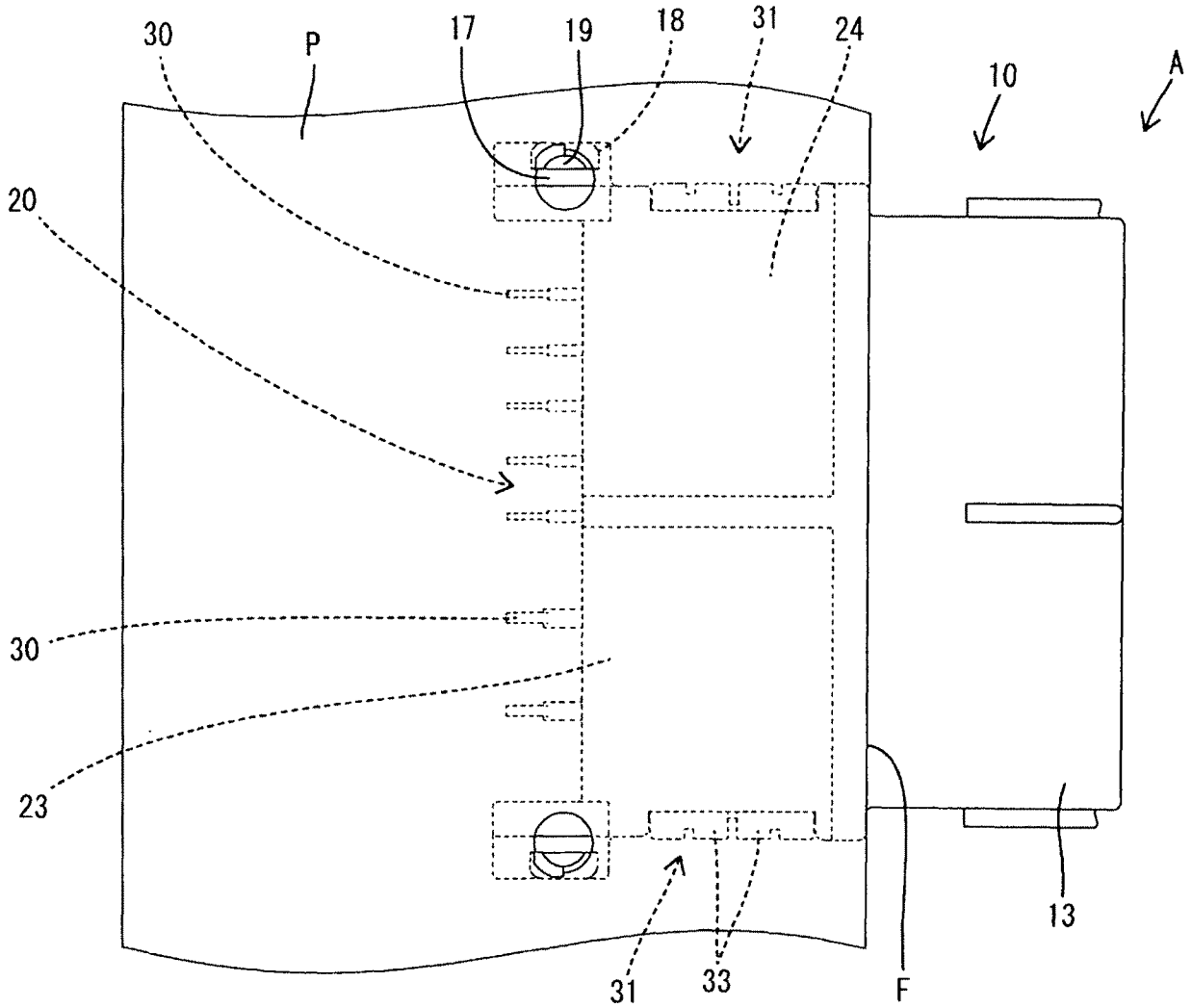
FIG. 4 is a bottom view in the state where the board connector is mounted on the circuit board.
Figure 5:
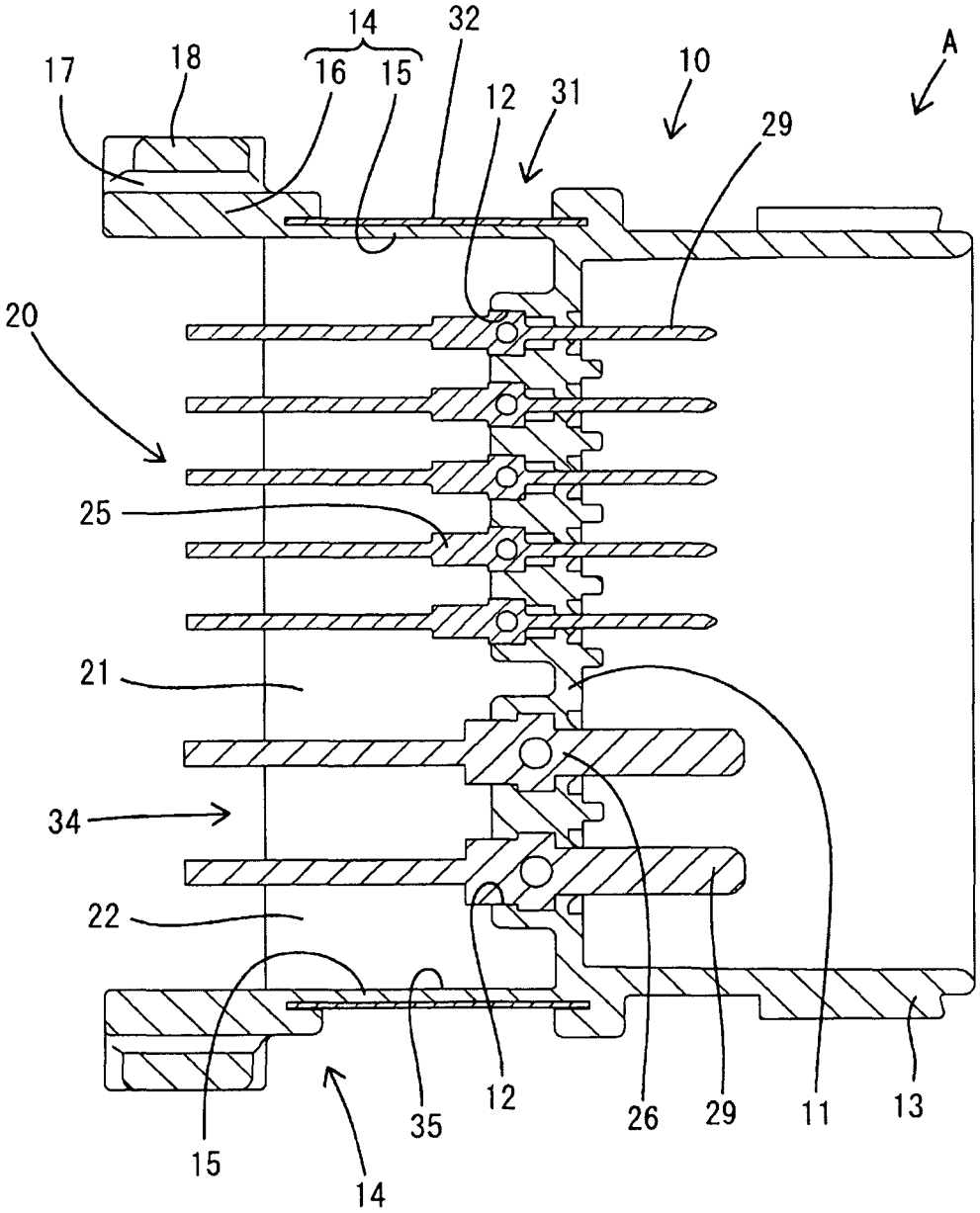
FIG. 5 is a section along X-X of FIG. 3.

A specific embodiment of the invention is described with reference to FIGS. 1 to 11. Note that, in the following description, a right side in FIGS. 2, 4, 5, 6 and 8 is defined as a front concerning a front-rear direction. Upper and lower sides shown in FIGS. 1 to 3, 6 and 7 are defined as upper and lower sides concerning a vertical direction.

A board connector A of this embodiment is fixed by being placed on a front part of the upper surface of a circuit board P. The circuit board P is formed with left and right locking holes H that are disposed at positions slightly behind a front edge F of the circuit board P and spaced apart by a predetermined distance in a lateral direction.

The board connector A includes a housing 10 made of synthetic resin, terminal fittings 25, 26, and left and right fixing brackets 31. The housing 10 is a single component including a terminal holding portion 11, a receptacle 13, two bilaterally symmetrical side walls 14, two bilaterally symmetrical locking portions 19, an upper wall 22 and a lower wall 24. The terminal holding portion 11 is a wall substantially at a right angle to the upper surface of the circuit board P and a wall thickness direction thereof is oriented in the front-rear direction. Press-fit holes 12 penetrate through the terminal holding portion 11 in the front-rear direction. The receptacle 13 is a substantially rectangular tube projecting forward from the outer peripheral edge of the terminal holding portion 11.

Figure 9:
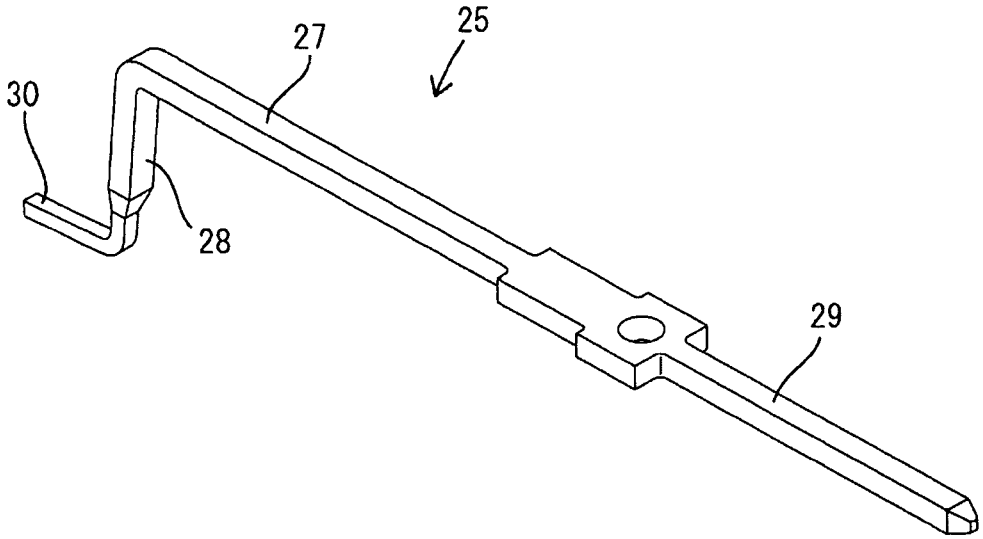
FIG. 9 is a perspective view of a first terminal fitting.
Figure 10:
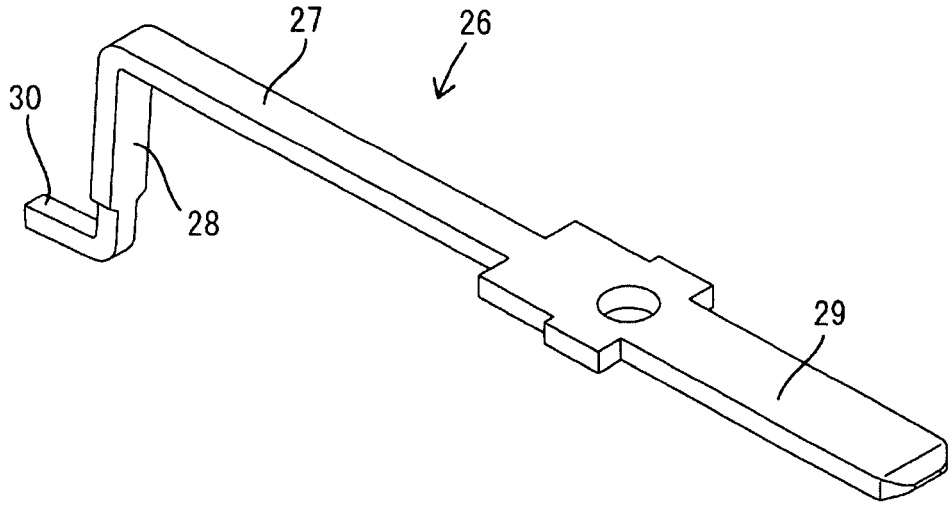
FIG. 10 is a perspective view of a second terminal fitting.
Figure 11:
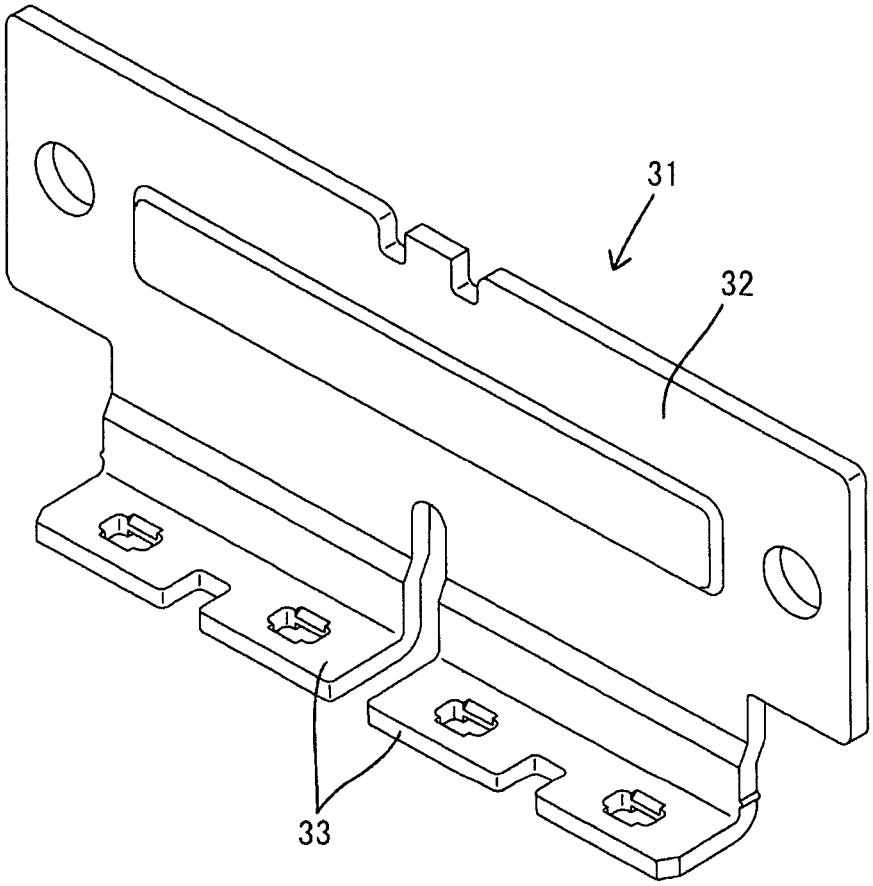
FIG. 11 is a perspective view of a fixing bracket.

First terminal fittings 25 and second terminal fittings 26 are mounted into the terminal holding portion 11 by being press-fit into the press-fit holes 12 from behind. As shown in FIGS. 9 and 10, each of these terminal fittings 25, 26 is formed by bending an elongated bar material and includes a harness side connecting portion 27 extending in the front-rear direction and penetrating through the terminal holding portion 11 and a board connecting portion 28 extending down substantially at a right angle from the rear end of the harness side connecting portion 27. A front part of the harness side connecting portion 27 is accommodated in the receptacle 13 and functions as a tab 29 connectable to a mating terminal (not shown) of a harness side connector (not shown). The board connecting portion 28 is disposed behind the terminal holding portion 11, and a lower end part thereof serves as a conductive portion 30 projecting horizontally rearward.

The left and right side walls 14 are cantilevered rearward from both left and right side of the terminal holding portion 11, and wall thickness directions thereof are oriented in the lateral direction. Front end regions of the side walls 14 directly connected to the terminal holding portion 11 function as supporting walls 15. The fixing brackets 31 are mounted on the outer surfaces of the supporting walls 15. The supporting walls 15 (side walls 14) function to support the fixing brackets 31. Each fixing bracket 31 is a single component including a plate-like mounting portion 32 disposed to cover the outer surface of the supporting wall 15 and a fixing portion 33 projecting laterally out from the lower end edge of the plate-like mounting portion 32 and disposed at such a height as to be substantially flush with the lower end of the supporting wall 15.

Figure 6:
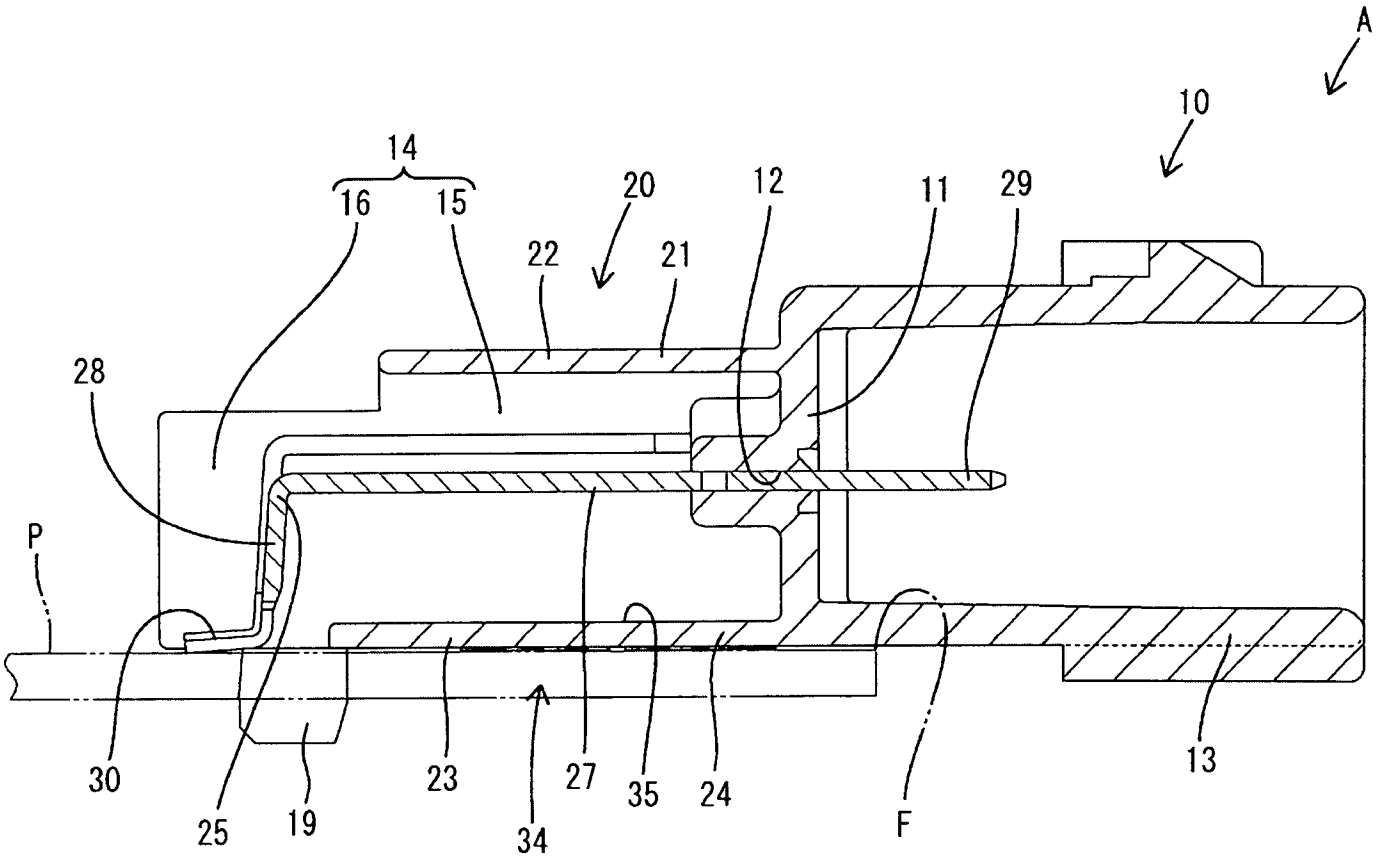
FIG. 6 is a side view in section of the board connector.
Figure 7:
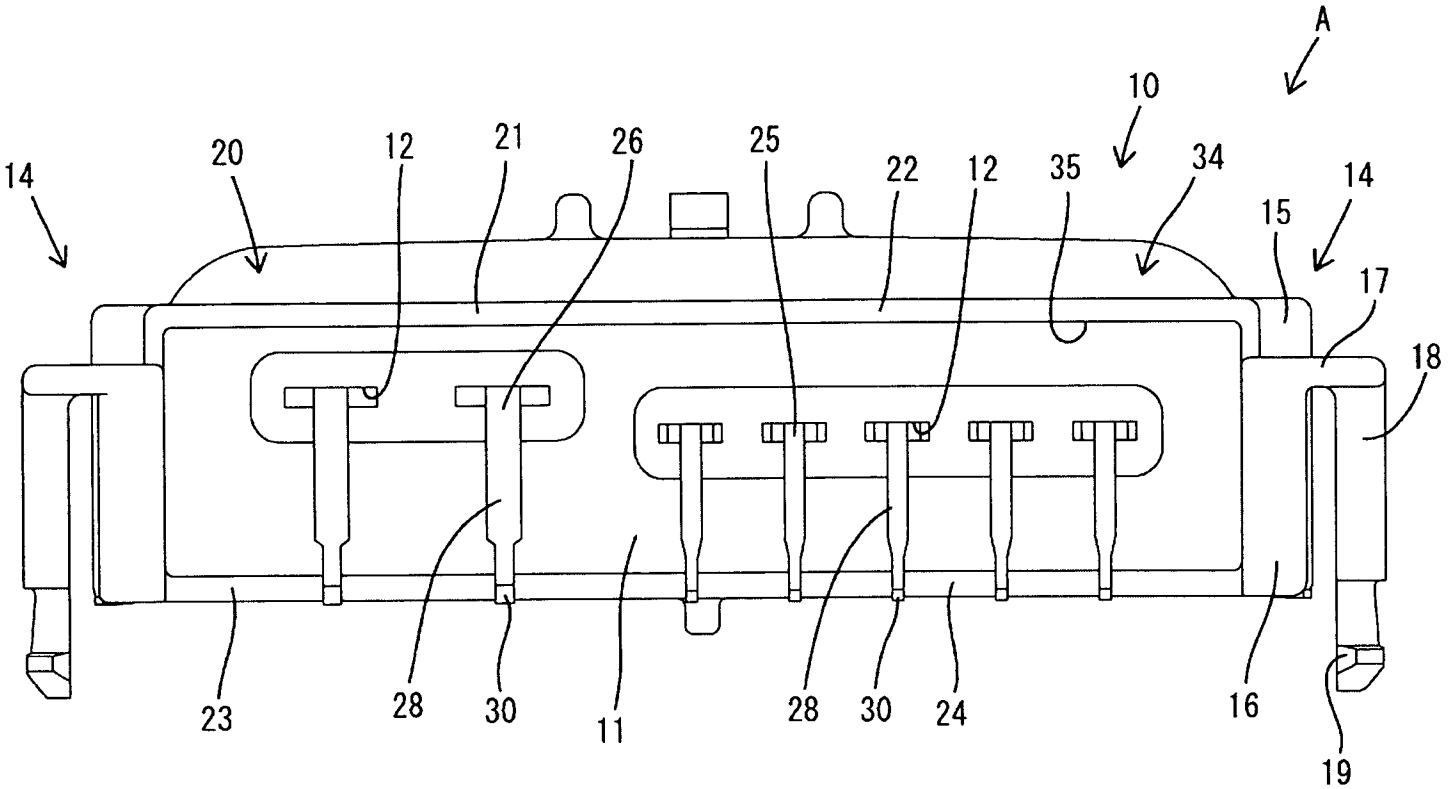
FIG. 7 is a back view of the board connector.
Figure 8:
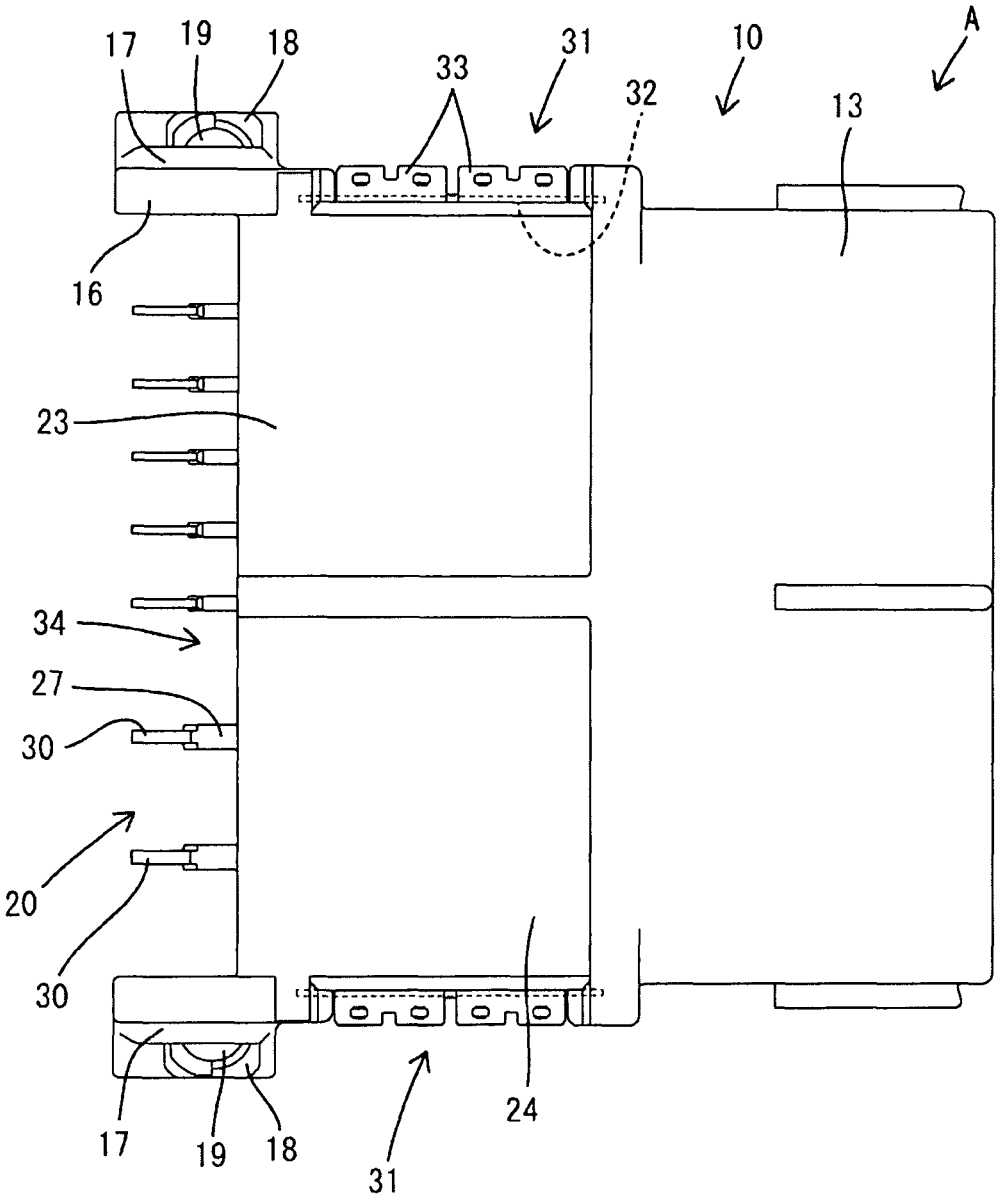
FIG. 8 is a bottom view of the board connector.

A rear end region of the side wall 14 functions as a protection wall 16. As shown in FIG. 6, the rear end of the protection wall 16 (rear end of the housing 10) is disposed substantially at the same position as the rear ends of the conductive portions 30 (board connecting portions 28) of the terminal fittings 25, 26 in the front-rear direction. Particularly, the rear end of the protection wall 16 is located slightly behind the rear ends of the conductive portions 30. Thus, the left and right side walls 14 are located to sandwich regions of the terminal fittings 25, 26 exposed rearward from the terminal holding portion 11 from both left and right sides, and have a function of protecting these terminal fittings 25, 26 from the interference of external matter.

Upper end parts of the both left and right protection walls 16 serve as resilient supports 17 in the form of ribs projecting laterally outward. The resilient supports 17 are resiliently deformable. Legs 18 extend down on projecting ends of the resilient supports 17. A lock 19 projects down from the lower end surface of each leg 18. A locking projection to be locked to a lower end part of an opening edge of the locking hole H of the circuit board P is formed on the outer periphery of a lower end part of the lock 19. The lock 19 is disposed substantially at the same position as the conductive portions 30 of the board connecting portions 28 of the terminal fittings 25, 26 in the front-rear direction. Further, the lock 19 is disposed behind the fixing bracket 31.

The housing 10 is formed integrally with a reinforcing portion 20 as a means for restricting or suppressing lateral tilt of the left and right side walls 14. The reinforcing portion 20 includes an upper linking portion 21 and a lower linking portion 23. The upper linking portion 21 links upper end parts of the supporting walls 15 and an upper end of the rear surface of the terminal holding portion 11, and constitutes the upper wall 22. The lower linking portion 23 links lower ends of the supporting walls 15 and a lower end of the rear surface of the terminal holding portion 11, and constitutes the lower wall 24.

The upper wall 22 is a plate-like part substantially at a right angle to the rear surface of the terminal holding portion 11 and the supporting walls 15 and has a substantially rectangular shape in a plan view. The front end of the upper wall 22 is connected to the upper end of the terminal holding portion 11 over the entire length (entire width) thereof. Both left and right sides of the upper wall 22 are connected to the upper ends of the supporting walls 15 over the entire lengths thereof. The upper wall 22 has substantially the same dimension in the front-rear direction as the supporting walls 15. Thus, the protection walls 16 project rearward from the rear end of the upper wall 22.

The lower wall 24 is a plate-like part substantially at a right angle to the rear surface of the terminal holding portion 11 and the supporting walls 15 and having a substantially rectangular shape in a plan view. The front end of the lower wall 24 is connected to the lower end of the terminal holding portion 11 over the entire length (entire width) thereof. Both left and right sides of the lower wall 24 are connected to the lower ends of the supporting walls 15 over the entire lengths thereof. The lower wall 24 has substantially the same dimension in the front-rear direction as the supporting walls 15. Thus, the protection walls 16 project rearward from the rear end of the lower wall 24.

A region of the housing 10 behind the terminal holding portion 11 serves as a box 34 defined by the terminal holding portion 11, the left and right supporting walls 15, the upper wall 22 and the lower wall 24. An internal space of this box 34 serves as a terminal accommodation space 35 having a rear surface open to outside. Regions of the harness side connecting portions 27 of the terminal fittings 25, 26 projecting rearward from the terminal holding portion 11 and regions of the board connecting portions 28 excluding rear end parts are accommodated in the terminal accommodation space 35. The rear end parts of the board connecting portions 28 including the conductive portions 30 project rearward from the terminal accommodation space 35, but are sandwiched from both left and right sides by the left and right protection walls 16. Thus, there is no possibility that these rear end parts are interfered with by external matter in the lateral direction.

The board connector A of this embodiment includes the housing 10 and the terminal fittings 25, 26. The housing 10 includes the terminal holding portion 11 and the receptacle 13 extending forward from the outer peripheral edge of the terminal holding portion 11, and is placed on the circuit board P. The terminal fittings 25, 26 are mounted while penetrating through the terminal holding portion 11, and connected to the circuit board P while being placed on the circuit board P behind the terminal holding portion 11.

In mounting this board connector A on the circuit board P, the board connector A and the circuit board P are passed through a reflow furnace and solder on the circuit board P is melted under a high-temperature environment of the reflow furnace with the housing 10 placed at a predetermined position of the circuit board P. Thus, the fixing portions 33 of the fixing brackets 31 and the conductive portions 30 of the terminal fittings 25, 26 are fixed to the circuit board P. In passing the circuit board P and the board connector A through the reflow furnace, the housing 10 is placed on the upper surface of the circuit board P. Since the board connector A of this embodiment is waterproof, the housing 10 needs to be placed on the circuit board P so that the receptacle 13 projects farther forward than the front end edge F of the circuit board P in a plan view. The reason for that is as follows.

If the board connector A is waterproof, the harness side connector (not shown) to be connected to the board connector A is provided with a sealing ring to be held in close contact with the inner periphery of the receptacle 13 and a tubular fitting for protecting the sealing ring. Thus, when the tubular fitting is fit to the outer periphery of the receptacle 13, the interference of the tubular fitting and the circuit board P needs to be avoided. Therefore, the receptacle 13 needs to be disposed farther forward than the front end edge F of the circuit board P.

If the terminal fittings 25, 26 are caused to project outward in front of the circuit board P, the board connector A may be tilted forward and detached from the circuit board P when the board connector A is placed on the circuit board P. As a means for stably placing the board connector A on the circuit board P, the housing 10 is formed with the locks 19 for restricting a forward tilting displacement of the housing 10 by being locked to the circuit board P in the board connector A of this embodiment. Forward tilting displacement of the housing 10 is restricted by inserting these locks 19 into the locking holes H of the circuit board P for locking. Therefore, the board connector A can be placed stably on the circuit board P.

The size of the locks 19 and a thickness of the circuit board P unavoidably vary within the range of dimensional tolerances in manufacturing. Thus, vertical rattling may occur between the locks 19 and the circuit board P when the locks 19 are locked into the locking holes H. As a countermeasure against this, the locks 19 are disposed on a rear end part of the housing 10, focusing on the front end edge F of the circuit board P serving as a fulcrum of a forward tilting displacement when the housing 10 is tilted forward and displaced. Therefore, even if rattling occurs between the locks 19 and the circuit board P, a vertical displacement amount of the housing 10 is suppressed to be equal to or less than the amount of rattling between the locks 19 and the circuit board P. In this way, the terminal fittings 25, 26 can be connected reliably to the circuit board P.

Further, the terminal fittings 25, 26 include the board connecting portions 28 to be fixed to the circuit board P by soldering while being placed on the circuit board P. When the housing 10 is tilted forward and displaced, the front edge F of the circuit board P serves as a fulcrum of a forward tiling displacement and both the board connecting portions 28 and the locks 19 are disposed behind the fulcrum of the forward tilting displacement. Focusing on this point, the locks 19 are disposed substantially at the same position as the board connecting portions 28 in the front-rear direction. According to this configuration, even if vertical rattling occurs between the locking portions 19 and the circuit board P, vertical displacement amounts of the board connecting portions 28 are suppressed to be equal to or less than the amount of rattling between the locks 19 and the circuit board P. In this way, the terminal fittings 25, 26 can be connected reliably connected to the circuit board P.

Furthermore, the housing 10 is formed with the side walls 14 extending rearward from the sides of the terminal holding portion 11, and the fixing brackets 31 fixable to the circuit board P by soldering are mounted on the side walls 14. When the housing 10 is tilted forward and displaced, the front edge F of the circuit board P serves as a fulcrum of a forward tiling displacement and both the fixing brackets 31 and the locks 19 are disposed behind the fulcrum of the forward tilting displacement. Focusing on this point, the locks 19 are disposed behind the fixing brackets 31.

According to this configuration, even if vertical rattling occurs between the locks 19 and the circuit board P, vertical displacement amounts of the fixing brackets 31 are suppressed to be equal to or less than the amount of rattling between the locks 19 and the circuit board P. In this way, the fixing brackets 31 can be reliably soldered to the circuit board P.

Further, the housing 10 is formed with the side walls 14 extending rearward from the sides of the terminal holding portion 11, the side walls 14 are formed with the legs 18 connected via the resilient supports 17, and the locks 19 are formed on the lower parts of the legs 18. According to this configuration, even if the positions of the locking holes H of the circuit board P and the positions of the locking portions 19 of the housing 10 vary in the front-rear direction and lateral direction, such variations (dimensional errors) are absorbed by resilient deformation of the resilient supports 17. Therefore, there is no possibility that excessive stress is generated at the locks 19.

Further, the board connector A includes the left and right side walls 14 extending rearward from the sides of the terminal holding portion 11 and disposed to sandwich the terminal fittings 25, 26, and the fixing brackets 31 mounted on the side walls 14 and fixable to the circuit board P by soldering. The locks 19 are provided to be continuous with the side walls 14. According to this configuration, since the side walls 14 have a function of supporting the fixing brackets 31, a function of protecting the terminal fittings 25, 26 from both left and right sides and a function of supporting the locks 19, the shape of the housing 10 can be simplified as compared to the case where dedicated parts for exhibiting these three functions are formed separately.

The board connector A of this embodiment includes the housing 10, the terminal fittings 25, 26 and the fixing brackets 31. The housing 10 includes the wall-like terminal holding portion 11 substantially at a right angle to the circuit board P and the left and right supporting walls 15 extending rearward from the sides of the terminal holding portion 11, and is placed on the circuit board P. The terminal fittings 25, 26 are mounted while penetrating through the terminal holding portion 11, and connected to the circuit board P behind the terminal holding portion 11. The fixing brackets 31 are mounted on the supporting walls 15 and fixed to the circuit board P by soldering.

As a means for alleviating stress generated at soldered parts of the fixing brackets 31 mounted on the housing 10 and the circuit board P, the housing 10 is formed integrally with the reinforcing portion 20 linking the supporting walls 15 and the rear surface of the terminal holding portion 11. The reinforcing portion 20 links the supporting walls 15 to the terminal holding portion 11 to suppress tilt. In this way, stress generated at the soldered parts of the fixing brackets 31 and the circuit board P due to the tilt of the supporting walls 15 is suppressed.

Further, the reinforcing portion 20 includes the upper linking portion 21 linking the upper ends of the supporting walls 15 and the upper part of the terminal holding portion 11. According to this configuration, the upper ends of the supporting walls 15 have a maximum displacement amount when the supporting walls 15 are tilted. However, the upper ends of the supporting walls 15 are linked to the terminal holding portion 11 via the upper linking portion 21. Thus, the tilt of the supporting walls 15 can be suppressed effectively. Furthermore, the upper linking portion 21 constitutes the plate-like upper wall 22 and is substantially at a right angle to the terminal holding portion 11 and the supporting walls 15. Since the plate-like upper wall 22 has a high rigidity, the tilt of the supporting walls 15 can be suppressed effectively.

Further, the reinforcing portion 20 includes the lower linking portion 23 linking the lower ends of the supporting walls 15 and the lower end of the terminal holding portion 11. In a state before the housing 10 is mounted on the circuit board P, external matter may interfere from below with the regions of the terminal fittings 25, 26 projecting rearward from the terminal holding portion 11. However, the lower linking portion 23 prevents the interference of external matter with the terminal fittings 25, 26 from below. Furthermore, the lower linking portion 23 constitutes the plate-like lower wall 24 substantially at a right angle to the terminal holding portion 11 and the supporting walls 15. Since the plate-like lower wall 24 has a high rigidity, the interference of external matter with the terminal fittings 25, 26 from below can be prevented.

Further, the upper wall 22 covers substantially the entire region of the upper surface of the terminal accommodation space 35 defined by the terminal holding portion 11 and the supporting walls 15. Thus, the regions of the terminal fittings 25, 26 accommodated in the terminal accommodation space 35 can be protected from interference of external matter. Similarly, the lower wall 24 covers substantially the entire region of the lower surface of the terminal accommodation space 35 defined by the terminal holding portion 11 and the supporting walls 15. Thus, the regions of the terminal fittings 25, 26 accommodated in the terminal accommodation space 35 can be protected from interference of external matter.

The invention is not limited to the above described and illustrated embodiment. For example, the following embodiments are also included in the scope of the invention.

Although the rear ends (board connecting portions) of the terminal fittings are disposed substantially at the same position as the rear end of the housing (side wall portions) in the front-rear direction in the above embodiment, the board connecting portions may be disposed in front of the rear end of the housing or may be disposed behind the rear end of the housing.

Although the locks are at substantially the same position as the board connecting portions of the terminal fittings in the front-rear direction in the above embodiment, the locks may be in front of the board connecting portions or may be behind the board connecting portions.

Although the locks are behind the fixing brackets in the above embodiment, the locks may be at substantially the same position as the fixing brackets in the front-rear direction or in front of the fixing brackets.

The side walls function to supporting the fixing brackets, the function of protecting the terminal fittings and the function of supporting the locks in the above embodiment. However, the side walls may have only one or two of these three functions.

Although the fixing brackets are mounted on the housing in the above embodiment, no fixing bracket may be mounted on the housing.

Although the bilaterally symmetrical locking portions are provided in the above embodiment, the locking portions may be bilaterally asymmetrical.

Although one housing is formed with two of the locks in the above embodiment, one, three or more locks may be formed.

Although the locks are formed on the side walls in the above embodiment, the locks may be disposed in a region (lower wall or terminal holding portion) of the housing other than the side walls.

LIST OF REFERENCE SIGNS

P . . . circuit board
A . . . board connector
10 . . . housing
11 . . . terminal holding portion
13 . . . receptacle
14 . . . side wall
17 . . . resilient supporting portion
18 . . . leg
19 . . . lock
25 . . . first terminal fitting (terminal fitting)
26 . . . second terminal fitting (terminal fitting)
28 . . . board connecting portion
31 . . . fixing bracket

The invention claimed is:

1. A board connector, comprising:

a housing placed on a circuit board, the housing including a terminal holding portion and a receptacle extending forward from an outer peripheral edge of the terminal holding portion; and a terminal fitting mounted while penetrating through the terminal holding portion, the terminal fitting having a board connecting portion connectable to the circuit board while being placed on the circuit board behind the terminal holding portion;

wherein:

the housing includes a lock for restricting a forward tilting displacement of the housing by being locked to the circuit board;

the terminal holding portion, the receptacle and the lock constitute a single component; and the lock is arranged on the housing so that all of the lock is at a position spaced rearward of the terminal holding portion and is disposed so that a rear end of the lock is more rearward than at least a front part of the board connecting portion of the terminal fitting that is placed on the circuit board.

2. A board connector, comprising:

a housing placed on a circuit board, the housing including a terminal holding portion and a receptacle extending forward from an outer peripheral edge of the terminal holding portion; and a terminal fitting mounted while penetrating through the terminal holding portion, the terminal fitting being connectable to the circuit board while being placed on the circuit board behind the terminal holding portion;

wherein:

the housing includes locks for restricting a forward tilting displacement of the housing by being locked to the circuit board;

the housing includes protection walls extending from the terminal holding portion, the protection walls having upper ends remote from the circuit board, resilient supports projecting laterally outward from the upper ends of the respective protection walls and legs extending down from ends of the resilient supports at positions laterally of the protection walls; and the locks extend down from lower ends of legs and being at positions spaced laterally out from the respective protection walls.

3. The board connector of claim 2, wherein each of the locks is disposed on a rear part of the housing.

4. The board connector of claim 3, wherein:

the terminal fitting includes a board connecting portion to be fixed to the circuit board by soldering while being placed on the circuit board; and each of the locks is disposed substantially at the same position as the board connecting portion in a front-rear direction.

5. The board connector of claim 1, further comprising a side wall extending rearward from a side edge part of the terminal holding portion, wherein:

a fixing bracket fixable to the circuit board by soldering is mounted on the side wall; and the lock is spaced rearward from the fixing bracket.

6. The board connector of claim 1, further comprising a side wall extending rearward from a side edge part of the terminal holding portion, wherein:

a resilient support projects laterally out from an upper end of the side wall and a leg extends down from the resilient support at a position spaced laterally out from the side wall; and the lock is formed on a lower end part of the leg.

7. The board connector of claim 1, further comprising:

left and right side walls extending rearward from side edge parts of the terminal holding portion and disposed to sandwich the terminal fitting; and fixing brackets mounted on the side walls, the fixing brackets being fixable to the circuit board by soldering;

wherein the locks are continuous with the side walls.

* * * * *